US005177350A

United States Patent [19]

Beauvais et al.

[11] Patent Number: 5,177,350

[45] Date of Patent: Jan. 5, 1993

[54] IMAGE INTENSIFIER TUBE WITH OPTIMIZED ELECTRICAL INSULATION

[75] Inventors: Yves Beauvais, Paris; Pierre Joly, Tullins; Jean-Marie Deon, Grenoble; Maurice Verat, St Martin le Vinoux, all of France

[73] Assignee: Thomson Tubes Electroniques, Boulogne Billancourt, France

[21] Appl. No.: 741,564

[22] Filed: Aug. 7, 1991

[30] Foreign Application Priority Data

Sep. 4, 1990 [FR] France ..... 90 10964

[51] Int. Cl.[5] ..... H01J 31/50; H01J 40/06

[52] U.S. Cl. ..... 250/214 VT; 313/544; 313/477 R

[58] Field of Search ..... 250/213 VT; 313/542, 313/543, 544, 530, 477 R, 313, 402; 315/85

[56] References Cited

U.S. PATENT DOCUMENTS

| | | | |
|---|---|---|---|
| 3,688,146 | 8/1972 | Bouwers | 313/530 |
| 3,858,050 | 12/1974 | Carlson | 250/361 |
| 4,045,700 | 8/1977 | Wulff | 250/213 VT |
| 4,171,480 | 10/1979 | Wulms | 250/213 VT |
| 4,245,160 | 1/1981 | Harao | 250/213 VT |
| 4,825,067 | 4/1989 | Kawamura et al. | 250/213 VT |
| 4,870,473 | 9/1989 | Sugimori | 250/213 VT |

FOREIGN PATENT DOCUMENTS

| | | |
|---|---|---|
| 0173851 | 3/1986 | European Pat. Off. . |
| 63-241848 | 10/1988 | Japan . |

*Primary Examiner*—David C. Nelms
*Assistant Examiner*—Michael Messinger
*Attorney, Agent, or Firm*—Oblon, Spivak, McClelland, Maier & Neustadt

[57] ABSTRACT

An apparatus for electrically insulating viewing windows in an image intensifier tube is disclosed. The mechanical parts which are located close to the window are electrically insulated with the metal parts being held at a high voltage and electrically insulated on the outside of the image intensifier by an insulating screen. The insulating screen includes electrically conductive layer 36 and an insulating layer 37 which separates the metal parts 20, 26 from the conductive layer. The conductive layer also forms an equipotential layer which is opposite the metal parts and thereby "freezes" the distribution of the electrical lines of force in the insulating screen 35.

9 Claims, 2 Drawing Sheets

IMAGE INTENSIFIER TUBE WITH OPTIMIZED ELECTRICAL INSULATION

FIELD OF THE INVENTION

This invention consists of image intensifier tubes and, more particularly, methods of improving the electrical insulation of the viewing windows in these tubes.

DESCRIPTION OF THE PRIOR ART

FIG. 1 schematically shows a conventional image intensifier tube, for example for a radiological application, which differs from other types mainly by the fact that it also includes a scintillation screen to convert X-ray photons into visible light.

The image intensifier tube consists of a sealed glass envelope 2, containing a vacuum, with an inlet window 3 at one end, exposed to X, X1,X2, . . . Xn rays forming a radiological image. A scintillation screen 4 converts the X-rays into light rays. The light rays excite a photocathode 5 causing it to release electrons. These electrons are collected from photocathode 5, accelerated and fed to a viewing window 6 located at the rear end 15 of envelope 2, that is at the opposite end to input window 3. For this purpose, the intensifier tube contains various electrode 7 and an anode 8 arranged around its longitudinal centerline 17.

The viewing window 6 includes a cathodoluminescent screen 9 which, as the electrons impact on it, reconstitutes the image (with greater luminance) which was initially formed on the surface of photocathode 5. This luminescent screen generally consists of a luminophor film, itself generally covered by a very thin film of conductive and reflective material, generally aluminium. The luminescent screen 9 is produced on a transparent glass support 12 and the assembly consisting of 12 and 9 is then mounted, by metal spacers 13, on a viewing window 18 formed by the envelope 2 walls 19.

The image produced on luminescent screen 9 is visible through the glass envelope 2. An optical system 10 is generally mounted outside the intensifier tube, close to the viewing window 6, to acquire this image and allow it to be observed.

This arrangement simplifies problems of electrically insulating the image intensifier tube, particularly from the optical system 10. Anode 8 is at a high potential compared to photocathode 5, which is generally at a potential close to ground. Depending on the case, the anode potential can be between +15 000 and +45 000 volts. Luminescent screen 9 is very close to anode 8 and is, therefore, at the same, or a very similar, potential to the anode potential particularly since its face turned towards photocathode 5 generally carries an electrically conductive film 11 connected to the anode 8 potential, or a very similar potential, to polarize luminescent screen 9.

In the example shown in FIG. 1, the high voltage positive polarity is applied to anode 8 by a sealed conductive component passing through the envelope 2. This conductive component is connected to anode 8 and metal film 11 is itself connected to the anode by metal spacers 13.

It can be seen that the viewing window 6 is supported by envelope 2 and that all components at the high voltage are contained in envelope 2 such that glass envelope 2 effectively electrically insulates the optical systems 10.

The conventional configuration shown in FIG. 1 has been satisfactorily used in many products. Certain manuafacturers have attempted to perfect the optical properties (to improve the image contrast and resolution), particularly by deleting the interfaces formed between the glass support 12 and the vacuum in space 14 and between this support and the envelope rear 15.

This has led to the production of image intensifier tubes similar to that shown in FIG. 1 except for the rear part 15 which contains the viewing window 6.

FIG. 2 is a part section on an image intensifier tube. It is a magnified view corresponding to the rear part 15 enclosed in box 16 on FIG. 1; it illustrates the modifications introduced to improve the optical properties.

The cathodoluminescent screen 9 and support 12 on which it is installed form part of the envelope since they close the intensifier tube and contribute to sealing it against the vacuum. Consequently, the assembly consisting of the cathodoluminescent screen 9 and its support 12 is attached to the glass envelope walls 19 by metal parts 20,26. Parts 20,26 are welded together, one initially being attached to walls 19 and the other to the glass support 12.

Consequently, glass support 12, which carries cathodoluminescent screen 9, has one face 22 which is on the outside of the tube. Conventional methods of improving contrast can then be applied to this face, for example a glass with selected absorbent properties and an anti-reflection treatment on its outer face 23, attached to glass support 12 by a film of glue 24; moreover, film 24 can be chosen to improve the optical contrast. The functions fulfilled by these last components were previously, at least partially, fulfilled by the glass envelope 2 as shown in FIG. 1 but eliminating the back part of the glass envelope 2 eliminates the interfaces mentioned previously.

However, the structure shown in FIG. 2 has a disadvantage in that metal parts 20,26 which carry glass support 12 and the cathodoluminescent screen 9 must be insulated because they are accessible from outside the tube.

These metal parts 20,26 are very close to anode 8 and are, therefore, naturally at a potential similar to that of the anode. In addition, as shown in the example in FIG. 2, these metal parts can also be used to carry the high voltage into the tube and to anode 8, for example using a high voltage cable whose core is soldered to metal part 20, and a conductive element between this part and the anode, metal film 11 being extended up to metal parts 20,26. It should be noted that the glass support 12 and walls 19 can only be mechanically connected by metal parts, mainly for reasons of mechanical strength, to obtain a vacuum-tight seal and due to machining problems.

To date, metal parts 20,26 are electrically insulated by covering them with a high-voltage insulating resin which forms a protective layer 30 whose thickness is determined by the value of the high voltage and the properties of the material used.

It has been found that this electrical insulation does not always offer the degree of protection required. In certain cases, the properties of protective layer 30 have been found to deteriorate, showing that tests in the factory are not sufficient to reproduce the wide variety of conditions encountered in use which result from the operating, installation and climatic conditions. The virtually unanimous conclusion is that the safety margins must be increased, mainly by increasing the thickness of the protective coat or improving the properties of the material used in it.

SUMMARY OF THE INVENTION

The originators of this invention used a different approach: they believe it is preferable to minimize any effects, on the protective coat, generated by components external to the image intensifier tube. On this basis, they attempted to "freeze" the profile of the electrical lines of force generated through the thickness of the insulating material, particularly to avoid any excessive local concentration in the lines of force, i.e. to avoid any general or localized increases in the strength of the electric field in the insulating material which could, in the long term, reduce the properties of this insulating material.

For example, the optical systems 10 may be enclosed in a metal box, held at the ground potential, and the electrical field strength in the protective layer 30 depends on the potential difference present but also on the distance between the optical systems 10 and metal parts 20,26. Consequently, the electric field strength may vary considerably from one installation to another particularly since the distance may not be constant and may therefore generate peaks in the electric field leading to very high localized field strengths.

This invention consists of image intensifier tubes, whether radiological or not, of a type in which one or more parts at a high electrical potential are located close to the viewing window and outside the tube envelope. The invention particularly consists of a protective layer formed on these parts held at high potential to electrically insulate them.

This invention is an image intensifier tube which includes a viewing window and metal parts located close to the viewing window, these metals parts being at a potential equal or close to one of the tube high voltage power supply potentials, the metal parts being electrically insulated from the outside of the tube by an insulating screen, in which the insulating screen includes an electrically conductive layer separated from the said metal parts by an electrically insulating layer.

This arrangement prevents the formation, in the insulating layer, of excessive localized concentrations of electrical lines of force due to the presence of components outside the tube, bearing in mind that these "components" can equally well be machanical parts as humidity or, in more general terms, any item capable of modifying the electrical field by conductive or dielectric effects.

In addition, this arrangement makes it possible, firstly, to connect the conductive layer to a predetermined potential and thus set up electrical conductions in the insulating layer compatible with the properties of the material used and avoid any changes to these conditions by the presence of external items and, secondly, to "drain" electrostatic charges. This means that the thickness of the insulating layer can be optimized and reduced to what is strictly necessary to suit the known operating conditions.

BRIEF DESCRIPTION OF THE DRAWINGS

The invention will be better understood upon reading the following description, which is not exhaustive, and by studying the appended figures including.

DETAILED DESCRIPTION OF THE INVENTION

Figure 3:
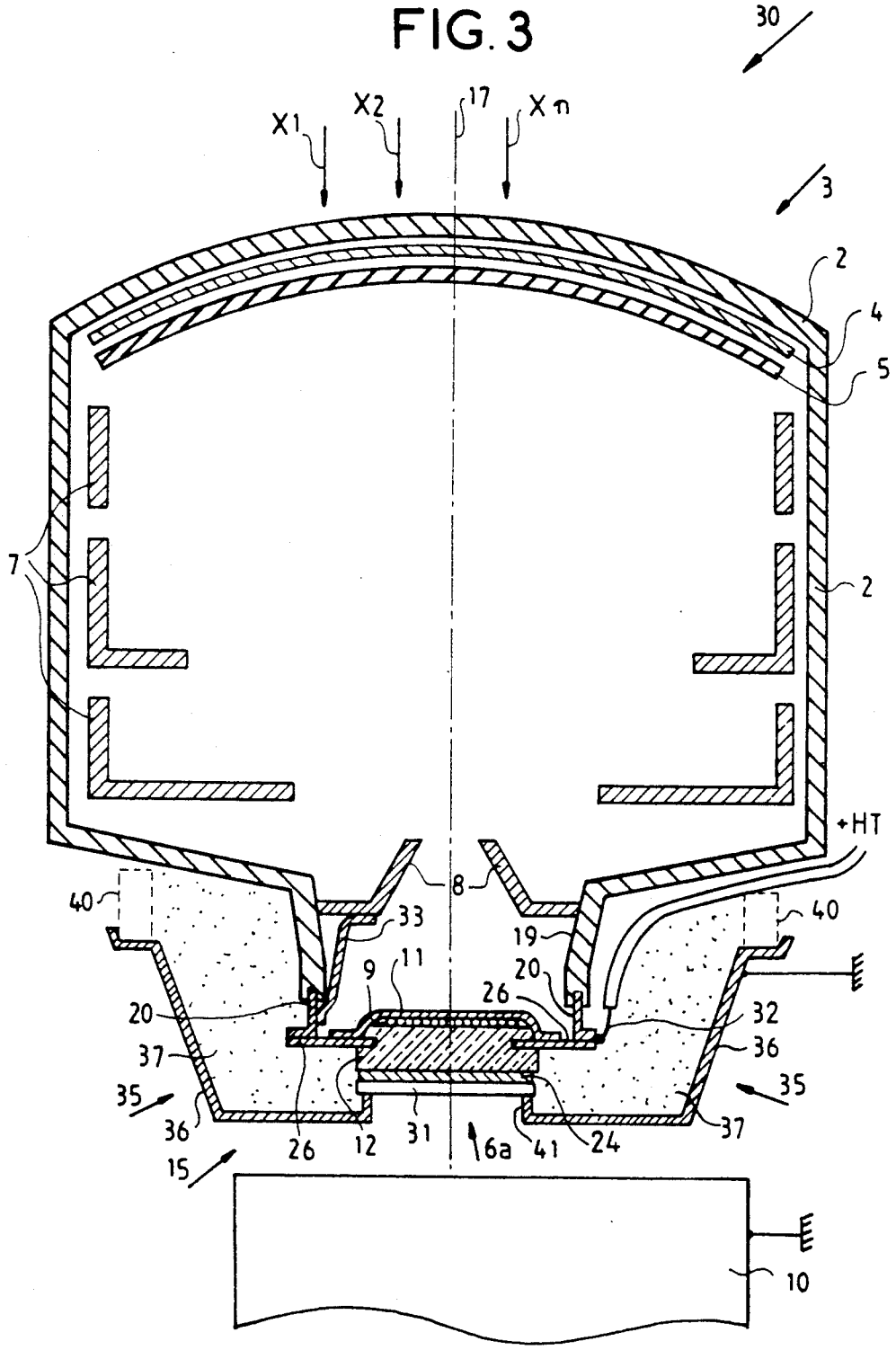
FIG. 3 schematically shows a preferred version of an image intensifier tube complying with this invention.

FIG. 3 shows an image intensifier tube 30 complying with this invention. The intensifier tube 30 includes, as in a conventional tube, a vacuum-sealed envelope 2, one end of which forms an inlet window 3. At the inlet window 3 end, the envelope 2 contains a scintallation screen 4 and a photocathode 5. Electrodes 7 are arranged around the intensifier tube longitudinal centerline 17. There is an anode 8 at the rear end 15 of the envelope, close to a viewing window 6*a*.

Figure 1:
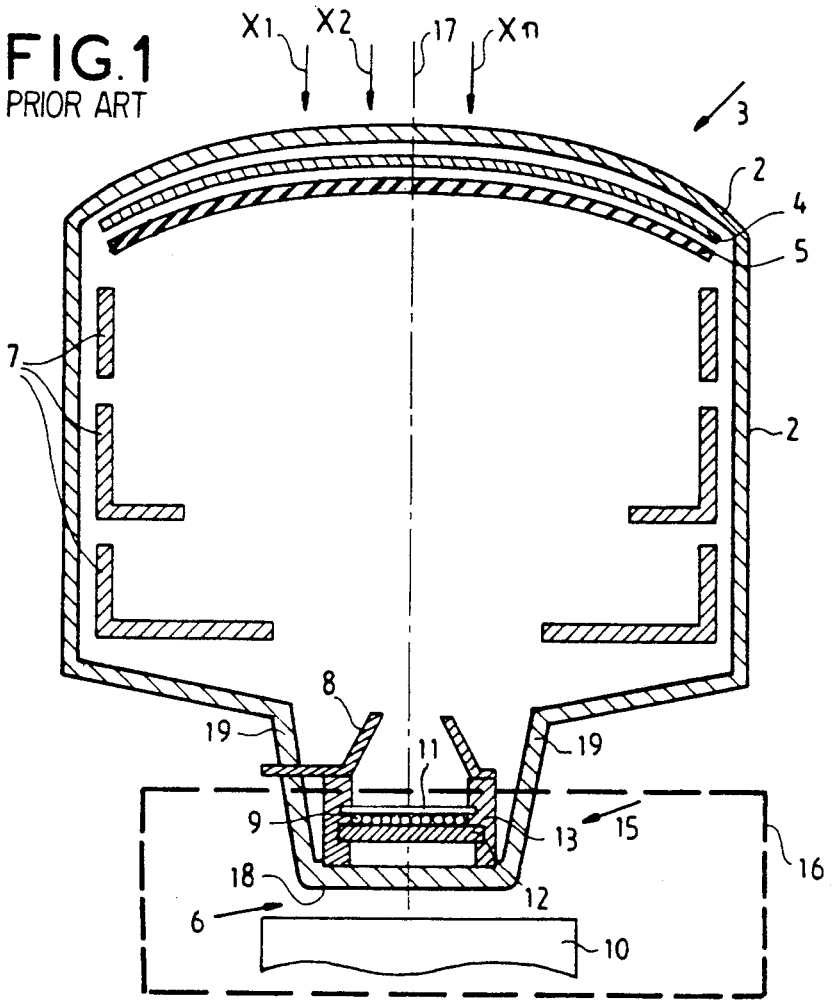
FIG.1 PRIOR ART
FIG. 1, already described, which shows a prior art image intensifier tube.
Figure 2:
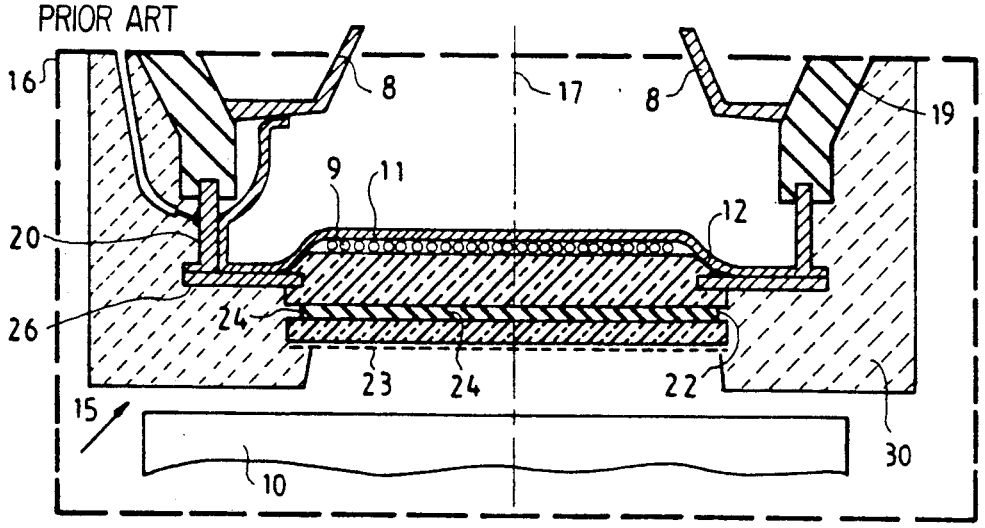
FIG.2 PRIOR ART
FIG. 2, already described, which shows a part-section on a prior art image intensifier tube in a version designed to improve the optical performance.

The intensifier tube 30 is of the type already shown in FIG. 2, i.e. the items which form the viewing window 6*a* are supported by metal parts 20,26, with which they form part of envelope 2; this is done to obtain the optical improvements already mentioned. In a similar way to the example in FIG. 2, the viewing window 6*a* comprises a glass support 12 to which a cathodoluminescent layer 9 is applied, itself covered by a thin metal sheet 11, for example in aluminium. Outside tube 30, glass support 12 carries a glass 31, retained by a layer of glue 24, to improve the contrast. Metal sheet 11 is extended to metal parts 20,26, to which a high voltage cable core 32 is soldered to apply the high voltage positive polarity. This high voltage positive supply is applied to anode 8 via a conductive element 33, as in the prior art example shown in FIG. 2.

Metal parts 20,26 are electrically insulated outside the tube 30 by an electrically insulating screen 35 applied to metal parts 20,26. A feature of the invention is that insulating screen 35 includes an electrically-conductive layer 36 and an electrically-insulating layer 37 which separates metal parts 20,26 from the said conductive layer 36.

Metal parts 20,26 are mounted around the longitudinal centerline 17 between envelope 2 and viewing window 6*a*; conductive layer 36 surrounds the centerline in virtually the same way.

Conductive layer 36 forms an equipotential surface surrounding metal parts 20,26. If an item at a different potential to that of metal parts 20,26 is present outside the tube, conductive layer 36 engenders a distribution of the lines of force (not shown) which is not appreciably modified by changing the position or potential or this outside item. The outside item could be, for example, the casing for optical systems 10 conventionally used to acquire the image formed by viewing window 6*a*; these optical systems normally use the ground or earth as a datum potential.

In addition, conductive layer 36 can be held at a fixed potential which, relative to the high voltage applied to the metal parts, maintains a potential difference between the metal parts and the conductive layer, this potential difference being equal to or less than a predefined maximum potential chosen to be compatible with the dielectric strength characteristics of the material which forms insulating layer 37. For example, conductive layer 36 can be connected to ground such that there are no dangers for users and such that it does not cause a short-circuit if it accidentially touches an item outside the tube.

The way in which conductive layer 36 is produced does not affect its action. It can be in any conductive material and be a flexible or rigid layer. However, the conductive layer 36 must have certain properties compatible with those of the material used in insulating layer 37, in particularlar its thermal coefficient of expansion and modulus of elasticity must be compatible.

It should be noted that, if conductive layer 36 is in sufficiently thick metal, i.e. in a solid form, it can also act as a mechanical screen to protect against accidental impacts, for example, which could damage insulating layer 37.

Another advantage of conductive layer 36 is that it can, itself, form a particularly efficient screen against humidity and elements in the ambient atmosphere; the efficiency of this screen will be increased if the edges of the conductive layer 36 are close to the tube envelope 2.

Various materials, themselves conventional, can be used for the insulating layer 37, for example various polymerized resins such as siliane, polyurethane, epoxy, etc. Polybutadiene-based polyurethane resins could also be used, particularly if the insulating screen 35 is to be kept as small as possible, for example to allow optical systems 10 to be placed as close as possible to viewing window 6. Tests have shown that this material, approximately 2 millimeters thick, is perfectly capable of withstanding potential differences of 30 000 volts relative to ground, this potential difference being applied to anode 8 and, therefore, to metal parts 20,26 with the conductive layer 36 connected to the ground, conductive layer 36 being produced in solid aluminium, i.e. approximately 0.5 millimeters thick. The thermal coefficient of expansion of insulating layer 37 and conductive layer 36 are different but the discrepancies are absorbed by the elasticity of the resin used in insulating layer 37 and by distortion of the metal screen which forms conductive layer 36. This is quite important since, during operation, these two layers 36,37 must remain in relatively close contact at all points on their common interface to avoid, as far as possible, causing changes in the electrical conditions in the insulator. In addition, aluminium and polyurethane resin have the advantage that they bind well to each other. It should be noted that, depending on the thickness and/or the type of material used for conductive layer 36, it may be necessary to include facilities to absorb the differences in the coefficients of expansion, for example bellows which can, themselves, be completely conventional.

The insulating resin, particularly that mentioned above, is simple to use. For example, it can be placed in position as a liquid, using a process completely conventional in itself, for example a circular mould whose walls 40 (shown by dotted lines) enclose metal parts 20,26. The space to be filled can be enclosed by the conductive layer 36 itself, which, for example, if it is in solid aluminium can include sealing edges 41, opposite its outer edges, as shown on FIG. 3, to prevent the liquid product escaping. The liquid product can be injected on the envelope 2 side and then flow, by gravity, to fill the space in which the electrical insulating layer is to be formed.

Obviously, other methods and many other known materials can be used to produce insulating layer 37.

In this invention, the electrically conductive layer 36 can be produced in various forms, for example as a flexible film. However, as mentioned above, conductive layer 36 can also form a mechanical screen and there is, therefore, an advantage in producing it in the "solid" form, i.e. from one or several metal sheets; the term "solid form" is used by opposition to a layer deposited on a flexible film. This conductive layer can also be in conductive materials other than aluminium, for example a very thin film of stainless steel; any differences in the thermal coefficient of expansion can be compensated for by, for example, expansion joint (not shown) in, for example, the form of ribs or bellows in the conductive layer itself.

What is claimed is:

1. An image intensifier tube being surrounded by an envelope and being supplied with a high voltage, said tube comprising:

a viewing window supported by metal parts wherein said metal parts have a potential approximately equal to the potential of said intensifier tube high voltage supply potentials;

an insulating screen for electrically insulating said metal parts on the outside of said image intensifier tube, said insulating screen including an electrically conductive layer and an electrically insulating layer with said electrically insulating layer separating said electrically conductive layer from said metal parts.

2. An image intensifier tube as described in claim 1, which is a radiological tube.

3. An image intensifier tube as described in claim 1, in which the conductive layer is connected to an electrical potential which, relative to the potential of metal parts, forms a potential difference equal to or less than a predetermined maximum value.

4. An image intensifier tube as described in claim 1 in which the insulating layer consists of a polymerized resin applied as a liquid to metal parts.

5. An image intensifier tube as described in claim 1, in which the insulating layer is a polybutadiene-based polyurethane resin.

6. An image intensifier tube as described in claim 1, in which the conductive layer is aluminium.

7. An image intensifier tube as described in claim 1, in which the conductive layer is stainless steel.

8. An image intensifier tube as described in claim 1, in which the conductive layer is a solid metal component.

9. An image intensifier tube as described in any one of the claims 1–8, in which the conductive layer extends almost to the image intensifier tube envelope to at least partially enclose metal parts and thus form a screen against humidity.

* * * * *